US008860652B2

(12) United States Patent
Yamashita

(10) Patent No.: US 8,860,652 B2
(45) Date of Patent: Oct. 14, 2014

(54) SHIFT REGISTERS, DISPLAY PANELS, DISPLAY DEVICES, AND ELECTRONIC DEVICES

(75) Inventor: Keitaro Yamashita, Kobe (JP)

(73) Assignees: Innocom Technology (Shenzhen) Co., Ltd., Shenzhen (CN); Innolux Corporation, Miao-Li County (TW)

( * ) Notice: Subject to any disclaimer, the term of this patent is extended or adjusted under 35 U.S.C. 154(b) by 140 days.

(21) Appl. No.: 13/593,424

(22) Filed: Aug. 23, 2012

(65) Prior Publication Data

US 2014/0055332 A1 Feb. 27, 2014

(51) Int. Cl.
*G09G 3/36* (2006.01)

(52) U.S. Cl.
USPC ..... 345/100; 345/98

(58) Field of Classification Search
USPC ..... 345/87–104
See application file for complete search history.

(56) References Cited

U.S. PATENT DOCUMENTS

| | | | | |
|---|---|---|---|---|
| 8,194,026 | B2 * | 6/2012 | Lee et al. | 345/100 |
| 8,232,941 | B2 * | 7/2012 | Yeo et al. | 345/87 |
| 8,289,261 | B2 * | 10/2012 | Lee et al. | 345/100 |
| 8,462,097 | B2 * | 6/2013 | Kim et al. | 345/100 |
| 2007/0040793 | A1 * | 2/2007 | Kim et al. | 345/100 |
| 2008/0036725 | A1 * | 2/2008 | Lee et al. | 345/100 |
| 2010/0164854 | A1 * | 7/2010 | Kim et al. | 345/100 |
| 2010/0302230 | A1 * | 12/2010 | Moon et al. | 345/212 |
| 2011/0012823 | A1 * | 1/2011 | Tsai et al. | 345/100 |

* cited by examiner

*Primary Examiner* — Dmitriy Bolotin

(57) ABSTRACT

A shift register is provided. In each of successively cascaded shift register units, for a first switch, control and output terminals are coupled to a first node and an output node respectively, and an input terminal receives a first clock signal. For a second switch, input and output terminals are coupled to the control terminal of the second switch and the first node respectively. For a third switch, a control terminal is coupled to the first node, and an input terminal receives the first clock signal. A first capacitor is coupled between an output terminal of the third switch and the first node. For a fourth switch, an input terminal is coupled to the first node, and an output terminal is coupled to a low voltage terminal. For a current shift register, a control terminal of the second switch receives an output signal generated by previous shift register unit.

20 Claims, 12 Drawing Sheets

SHIFT REGISTERS, DISPLAY PANELS, DISPLAY DEVICES, AND ELECTRONIC DEVICES

BACKGROUND OF THE INVENTION

1. Field of the Invention

The invention relates to a shift register, and more particularly to a shift register applied to a gate driver of a display panel.

2. Description of the Related Art

Generally, in an active matrix display device, a gate driver which is used to drive a pixel array comprises a shift register. The shift register comprises a plurality of shift register units to generate output signals to drive the pixel array through gate lines respectively. The output signals are enabled successively. For each output signal, when the transition speed on the falling edge of the pulse of the output signal is fast, visible flicker may induced. The flicker is more serious especially in display with higher resolution because of larger imbalance of voltage falling speed between far end and near end of the gate line, the difference which is by a larger time constant (consisted of parasitic resistance and capacitance along with gate line).

Thus, it is desired to provide a shift register which generates output signals with appropriate transition speed so as to minimize the imbalance of voltage falling speed between far end and near end of the gate line.

BRIEF SUMMARY OF THE INVENTION

An exemplary embodiment of a shift register is provided. The shift register comprises a plurality of successively cascaded shift register units. Each shift register is controlled by a first clock signal to generate an output signal at an output node. The output signals generated by the cascaded shift register units are enabled successively. Each of the shift register units comprises a first switch, a second switch, a third switch, a first capacitor, a fourth switch, and a second capacitor. A control terminal of the first switch is coupled to a first node, an input terminal thereof receives the first clock signal, and an output terminal thereof is coupled to the output node. An input terminal of the second switch is coupled to the control terminal of the second switch, and an output terminal thereof is coupled to the first node. A control terminal of the third switch is coupled to the first node, and an input terminal thereof receives the first clock signal. The first capacitor is coupled between an output terminal of the third switch and the first node. An input terminal of the fourth switch is coupled to the first node, and an output terminal thereof is coupled to a low voltage terminal. The second capacitor is coupled between the output node and a ground terminal. For a current shift register unit among the shift register units, a control terminal of the second switch receives the output signal generated by previous shift register unit to the current shift register unit.

An exemplary embodiment of a display panel is provided. The display panel comprises a plurality of source lines, a plurality of gate lines, a plurality of pixel units, a source driver, and a gate driver. The gate lines interlace with the gate lines. The pixel units are arranged to form a display array. Each pixel unit corresponds to one set of the interlaced source line and gate line. The source driver is coupled to the source lines and provides data signals to the display array through the source lines. The gate driver is coupled to the gate lines. The gate driver comprises the shift register of the above embodiment for generating output signals to the display array through the gate lines.

An exemplary embodiment of a display device is provided. The display device comprises the display panel of the above embodiment and a controller. The controller is operatively coupled to the display panel.

An exemplary embodiment of an electronic device is provided. The electronic device comprises the display device of the above embodiment and an input unit. The input unit is operatively coupled to the display device.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
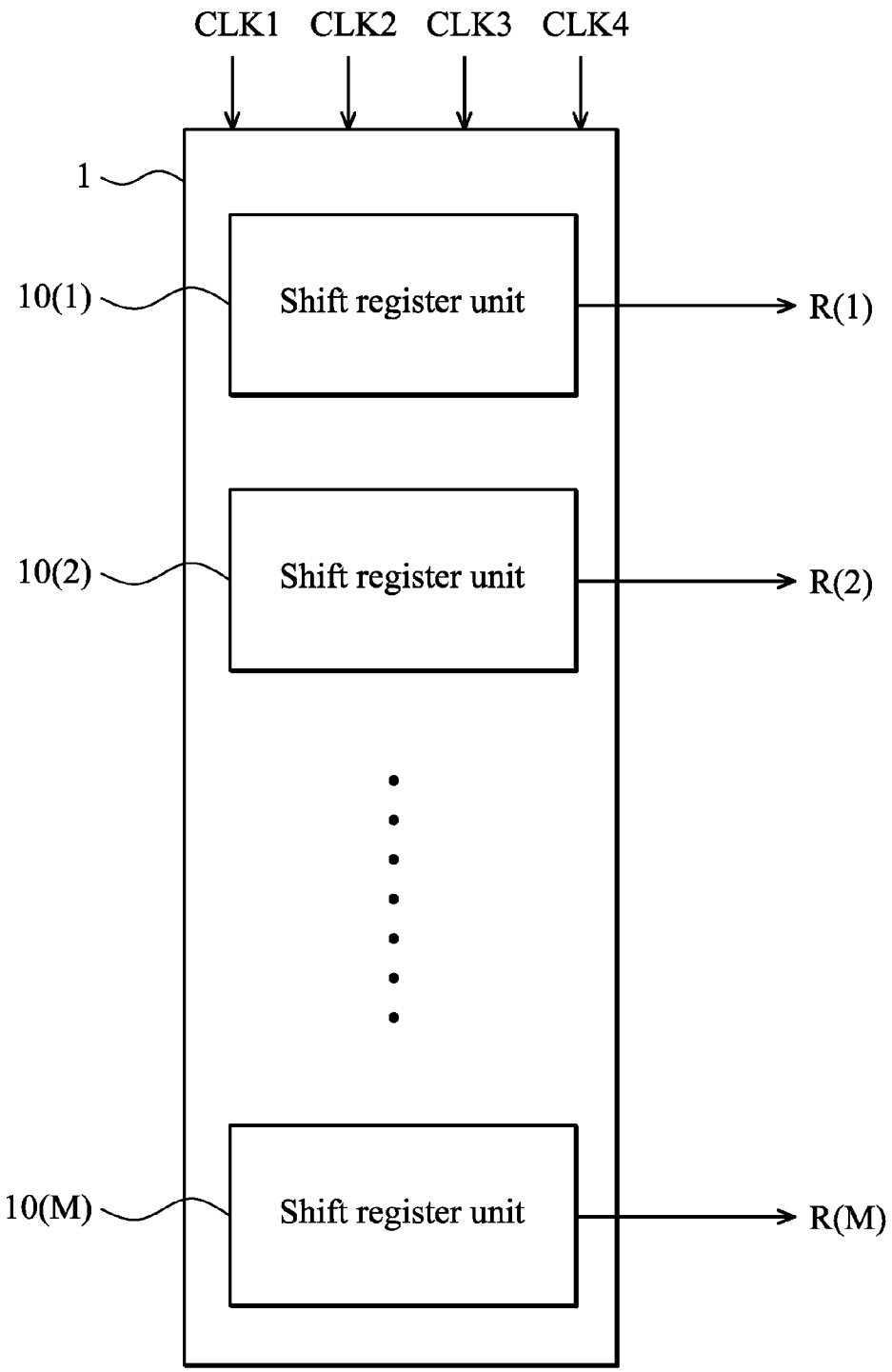
FIG. 1 shows an exemplary embodiment of a shift register.
Figure 2:
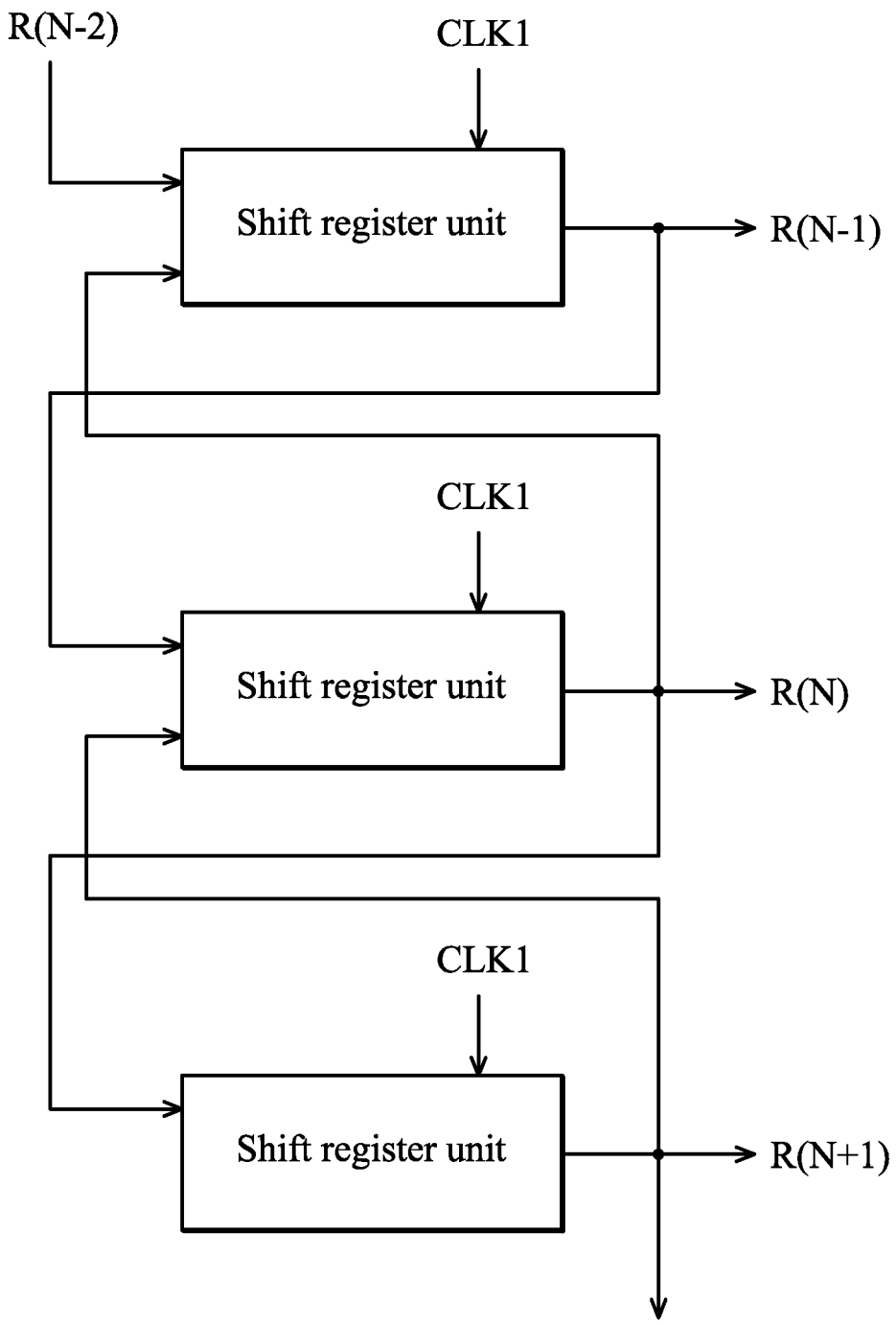
FIG. 2 shows exemplary shift register units among shift register units in the shift register of FIG. 1.

Shift registers are provided. In an exemplary embodiment of a shift register in FIG. 1, a shifter register 1 comprises a plurality of shift register units 10(1)~10(M) and operates according to at least one clock signal CLK1, wherein M is a positive integer. The shift register units 10(1)~10(M) are successively cascaded and generate output signals R(1)~R(M) respectively. The output signals R(1)~R(M) are enabled successively. FIG. 2 shows three exemplary shift register units among shift register units 10(1)~10(M) in the shift register 1. Referring to FIG. 2, each of the (N−1)-th to (N+1)-th register units 10(N−1)~10(N+1) among the shift register units 10(1)~10(M) receives the clock signal CLK1, an output signal generated by a previous shift register unit, and an output signal generated by a following shift register to generate the correspondingly output signal, wherein N is a positive integer and 3≤N≤M−2. For example, the N-th shift register unit 10(N) receives the clocks signal CLK1, the output signal R(N−1) generated by the (N−1)-th shift register unit 10(N−1), and the output signal R(N+1) generated by the (N+1)-th shift register unit 10(N+1) and generates the output signal R(N). The output signal R(N) generated by the N-th shift register unit 10(N) is provided to the (N+1)-th shift register unit 10(N+1). According to the rule of the receipt of the output signals by the N-th shift register unit 10(N) in the embodiment of FIG. 2, the previous output signal received by the first shift register unit 10(1) among shift register units 10(1)~10(M) may be generated by the M-th register unit 10(M) among shift register units 10(1)~10(M) or by other circuits in the shift register 1, and the following output signal received by the M-th shift register unit 10(M) among shift register units 10(1)~10(M) may be generated by the 1-th register unit 10(1) among shift register units 10(1)~10(M) or by other circuits in the shift register 1. The shift register 1 may be processed with amorphous silicon technology, low temperature poly-silicon technology, or oxide thin film transistor technology.

Figure 3:
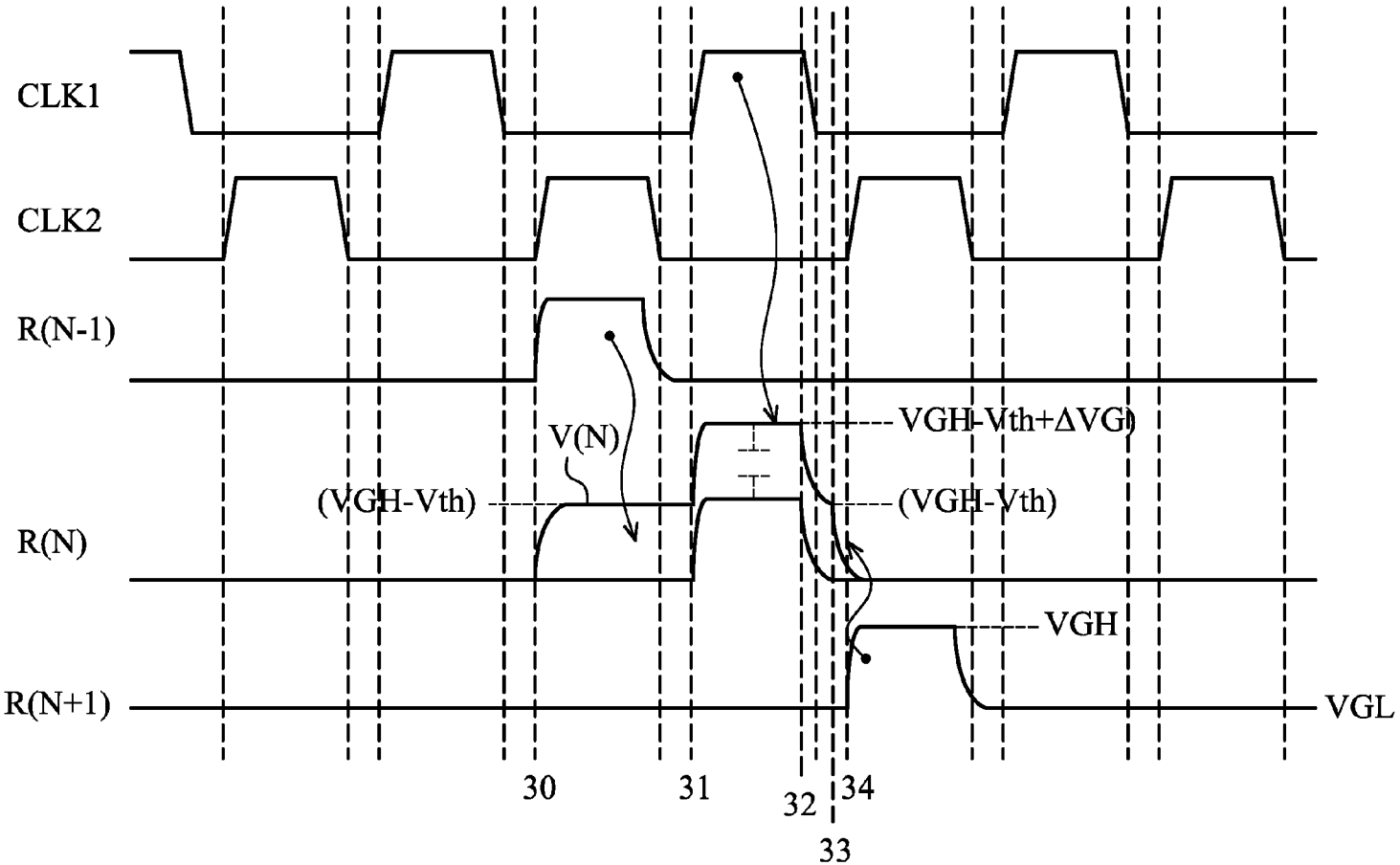
FIG. 3 shows timing of clock signals and the output signals and a waveform of a voltage signal for the shift register units of FIG. 2.

FIG. 3 shows timing of the clock signal CLK1, timing of a clock signal CLK2, timing of the output signals R(N−1)~R(N+1) and a waveform of a voltage signal V(N) generated in the N-th register unit 10(N) among shift register units 10(1)~10(M). Each of the clock signals CLK1 and CLK2 switches between a high voltage level VGH and a low voltage level VGL. As shown in FIG. 3, the clock signal CLK2 is complementary to the clock signal CLK1. The output signals R(N−1)~R(N+1) are enabled (high voltage level VGH) successively.

In the following, the N-th shift register unit 10(N) is given an example to illustrate the present invention.

Figure 4:
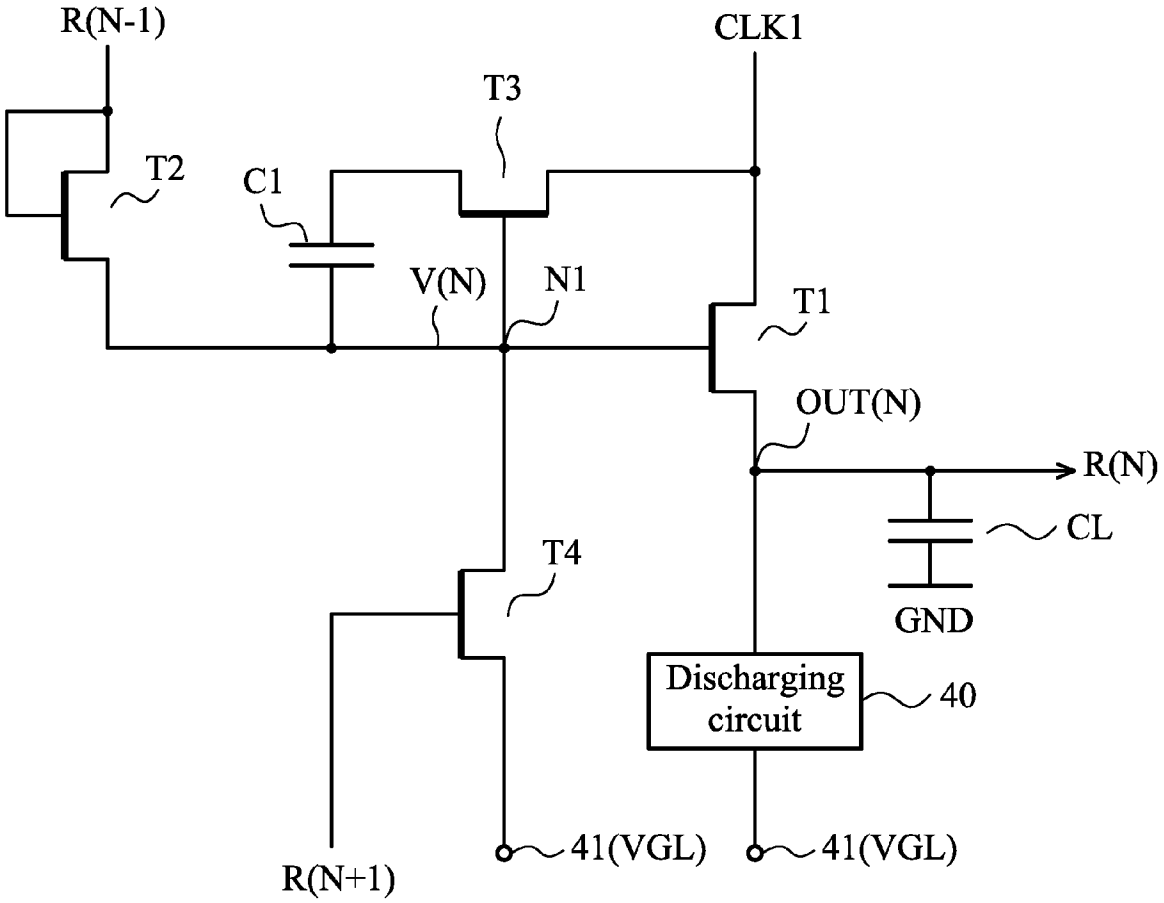
FIG. 4 shows one exemplary embodiment of one register units in the shift register of FIG. 1.

FIG. 4 shows one exemplary embodiment of the N-th register unit 10(N). Referring to FIG. 4, the N-th register unit 10(N) comprises switches T1~T4, two capacitors C1 and CL, and a discharging circuit 40. Each of the switches T1~T4 has a control terminal, an input terminal, and an output terminal. In the embodiment of FIG. 4, the switches T1~T4 are implemented by N-type transistor. For each of the switches T1~T4, the control terminal, the input terminal, and the output terminal are referred to as the gate, the drain, and the source of the N-type transistor. As shown in FIG. 4, the gate of the transistor T1 is coupled to a node N1, the drain thereof receives the clock signal CLK1, and the source thereof is coupled to an output node OUT(N) where the output signal R(n) is generated. The capacitor CL is coupled between the output node OUT(N) and a ground terminal GND. The gate and drain of the transistor T2 receive the output signal R(N−1) generated by the (N−1)-th register unit 10(N−1), and the source thereof is coupled to the node N1. According to the connection structure of the transistor T2, the transistor T2 acts as a diode. The gate of the switch T3 is coupled to the node N1, and the drain thereof receives the clock signal CLK1. The capacitor C1 is coupled between the source of the switch T3 and the node N1. The gate of the switch T4 receives the output signal R(N+1) generated by the (N+1)-th register unit 10(N+1), the drain thereof is coupled to the node N1, and the source thereof is coupled to a low voltage terminal 41. The discharging circuit 40 is coupled between the low voltage terminal 41 and the output node OUT(N). In the embodiment, the low voltage terminal 41 provides a voltage with the low voltage level VGL. The voltage signal V(N) is generated at the node N1.

The operation of the N-th shift register 10(N) will be described by referring to FIGS. 3 and 4. At the time point 30, the transistor T2 is turned on by the output signal R(N−1). The output signal R(N−1) with the high voltage level VGH is transmitted to the node N1 through the turned-on transistor T2. As the above description, the transistor T2 acts as a diode. Thus, during the period between the time point 30 to the time point 31, the voltage level of the voltage signal V(N) at the node N1 is increased to the voltage level (VGH−Vth) to turn on the transistor T1, wherein Vth represents the threshold of the transistor T2. Moreover, the transistor T1 is turned by the voltage signal V(N) with the voltage level (VGH−Vth). Since the clock signal CLK1 is at the low voltage level VGL, the output signal R(N) is at the low voltage level VGL (that is the output signal R(N) is at a disabled state).

At the time point 31, the clock signal CLK1 is switches to the high voltage level VGH. During the period between the time point 31 to the time point 32, through the feed-through effect of the capacitor C1, the voltage signal V(S) is increased rapidly by the difference ΔVG between the high voltage level VGH and the low voltage level (ΔVG=VGH−VGL), that is the voltage level of the voltage signal V(N) is increased to the voltage level (VGH−Vth+ΔVG). Due to the fast transition speed on the rising edge of the voltage signal V(N), the channel resistance of the transistor T1 is less. At this time, the time constant determined by the channel resistance of the transistor T1 and the capacitance of the capacitor CL is less. Thus, the capacitor CL is charged rapidly, such that the output signal R(N) is increased rapidly to the high voltage level VGH (enabled state) with the switching of the clock signal CLK1, that is the transition speed on the rising edge the output signal R(N) is fast.

At the time point 32, the clock signal CLK1 begins to switch to the low voltage level VGL. During the period between the time point 32 to the time point 33, through the feed-through effect of the capacitor C1, the voltage signal V(N) is decreased rapidly to the voltage level (VGH−Vth). Due to the fast transition speed on the falling edge of the voltage signal V(N), the channel resistance of the transistor T1 is less. At this time, the time constant determined by the channel resistance of the transistor T1 and the capacitance of the capacitor CL is less. Thus, the capacitor CL is discharged slowly, such that the output signal R(N) is decreased slowly to the low voltage level VGL (disabled state) with the switching of the clock signal CLK1, that is the transition speed on the falling edge of the output signal R(N) is slow.

At the time point 33, the clock signal CLK2 begins to switches to the high voltage level VGH to turn on the transistor T4. Thus, the voltage level of the voltage signal V(N) is decreased to the low level voltage VGL. After the time point 33, the discharging circuit 40 couples the output node OUT(N) to the low voltage terminal 41 (VGL). Accordingly, the extra pulse at the output node OUT(N) induced by channel leakage current can be prevented, such that the output signal R(N) can remain the low voltage level VGL when the output signal R(N) is at the disabled state after the time point 32.

The other shift register units have the same circuit structure of the N-th register unit 10(N) and operate according to the respective clock signals and the received output signals. In the (N−1)-th shift register unit 10(N−1), the gate of the transistor T2 receives the output signal R(N−2) generated by the (N−2)-th shift register unit 10(N−2), and the gate of the transistor T4 receives the output signal R(N) generated by the N-th shift register unit 10(N). In the (N+1)-th shift register unit 10(N+1), the gate of the transistor T2 receives the output signal R(N) generated by the N-th shift register unit 10(N), and the gate of the transistor T4 receives the output signal R(N+2) generated by the (N+2)-th shift register unit 10(N+2).

According to the circuit structure of the shift register units in FIG. 4, the transition speeds on the rising and falling edges of the voltage signal V(N) at the gate of the transistor T1 are fast. Accordingly, the transition speed on the rising edge of the output signal R(N) is fast, while the transition speed on the falling edge of the output signal R(N) is slow. When the shift register 1 is applied to a gate driver of a display device, visible flicker is reduced due to the slow transition speed on the falling edges of the output signals R(1)~R(M).

Figure 5:
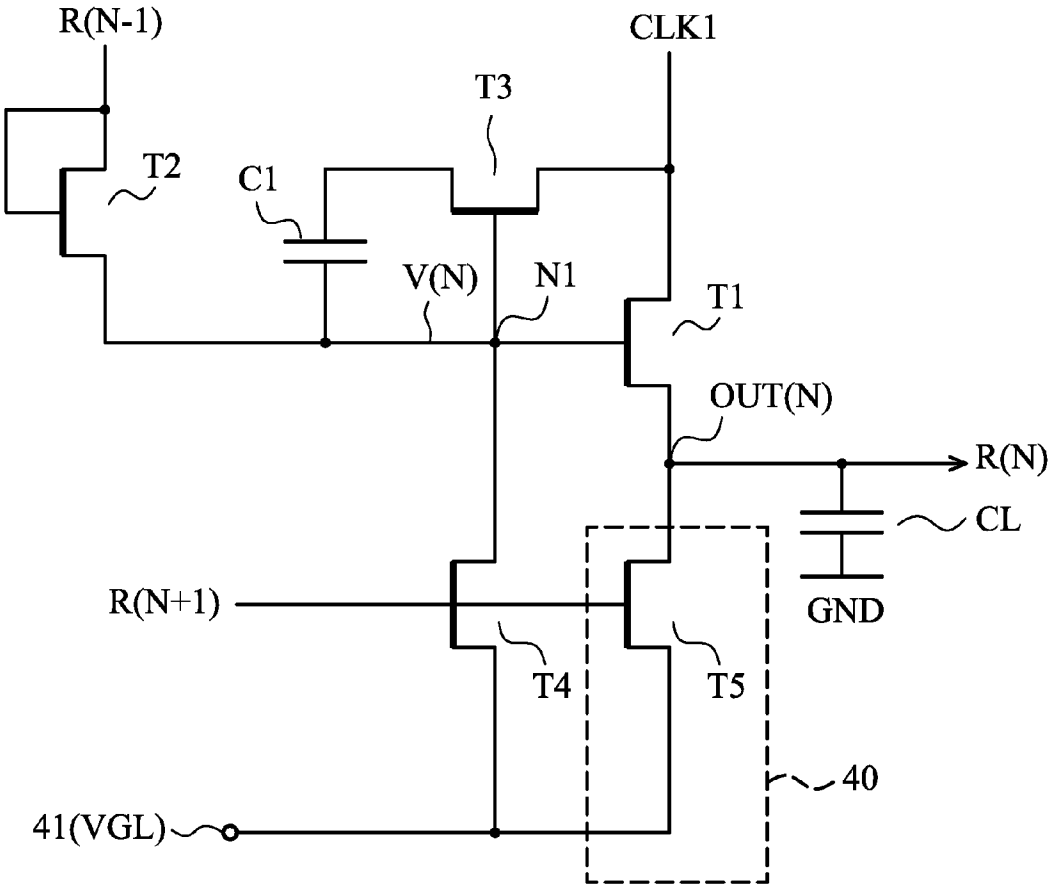
FIG. 5 shows one exemplary embodiment of a discharging circuit in the register unit of FIG. 4.

FIG. 5 shows one exemplary embodiment of the discharging circuit 40 in each shift register unit. The shift register unit 10(N) is given as an example. Referring to FIG. 5, the discharging circuit 40 comprises a switch T5. The switch T5 has a control terminal, an input terminal, and an output terminal. In the embodiment of FIG. 5, the switch T5 is implemented by N-type transistor. For the switch T5, the control terminal, the input terminal, and the output terminal are referred to as the gate, the drain, and the source of the N-type transistor. As shown in FIG. 5, the gate of the transistor is coupled to the gate of the transistor T4 to receive the output signal R(N+1), the drain thereof is coupled to the output node OUT(N), and the source thereof is coupled to the low voltage terminal 41 (VGL). Referring to FIGS. 3 and 5, in the period between the time point 33 to the time point 34, the output signal R(N+1) is at the high voltage level VGH to turn on the transistor T5, such that the node N1 and the output node OUT(N) are coupled to the low voltage terminal 41 (VGL).

Figure 6:
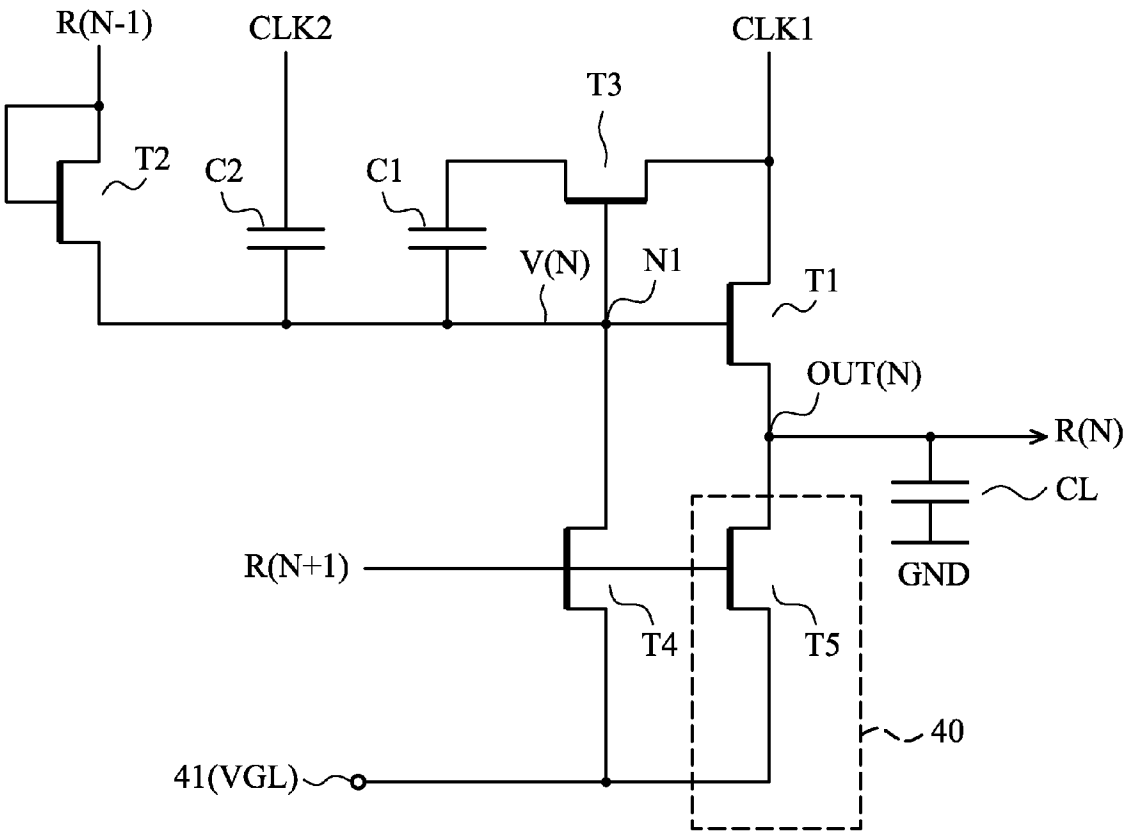
FIG. 6 shows another exemplary embodiment of one register units in the shift register of FIG. 1.

In the embodiment of FIG. 5, the N-th register unit 10(N) further comprises a capacitor C2. As shown in FIG. 6, one terminal of the capacitor C2 receives the clock signal CLK2, and the other terminal thereof is coupled to the node N1. The clock signal CLK2 is complementary to the clock signal CLK1. Accordingly, when the output signal R(N) is at the disabled state after the time point 32, the clock signal CLK2 is coupled to the node N1 through the capacitor C2 to suppress the beat induced from the clock signal CLK1 with the high voltage level VGH.

Figure 7:
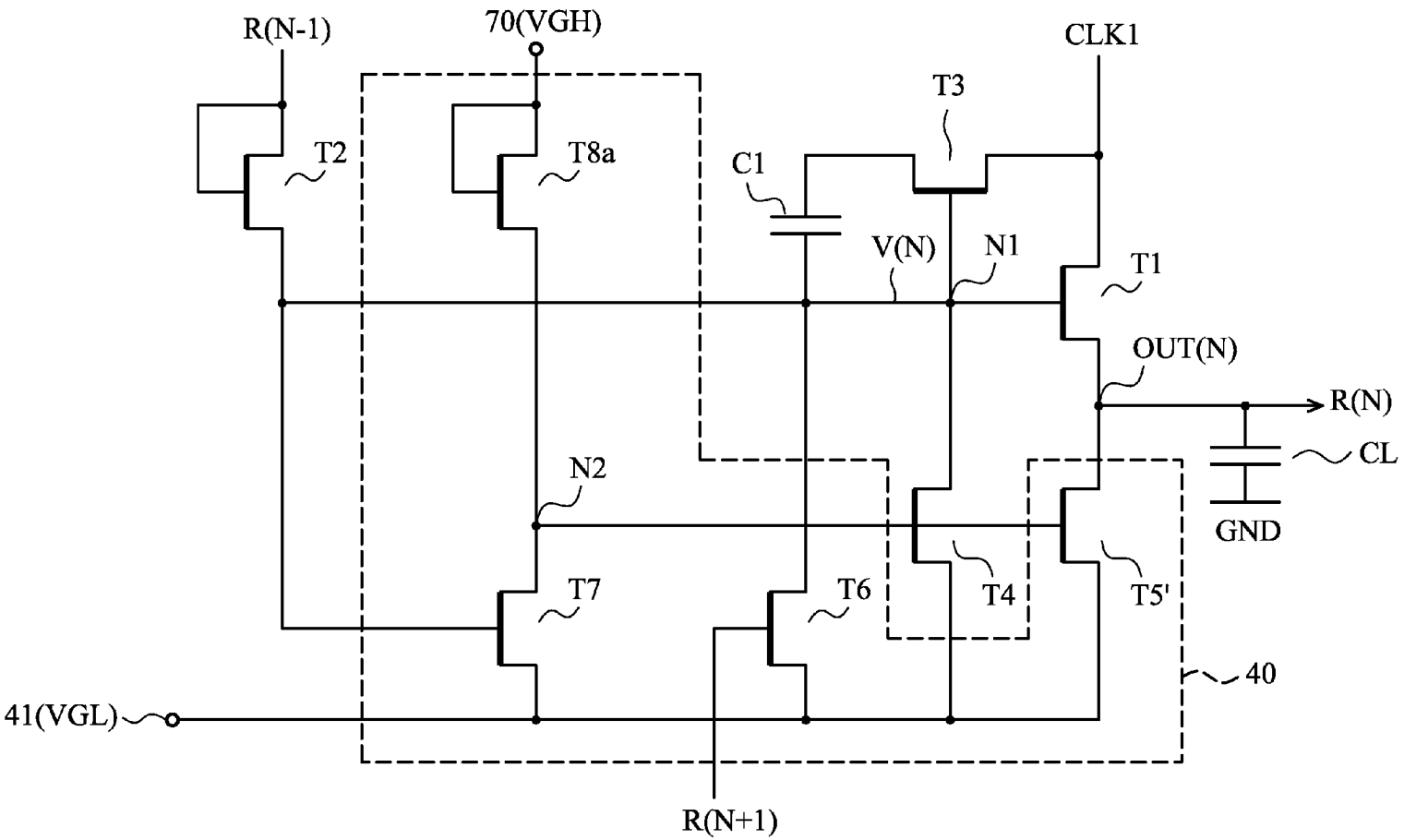
FIG. 7 shows another exemplary embodiment of a discharging circuit in the register unit of FIG. 4.

FIG. 7 shows another exemplary embodiment of the discharging circuit 40 in each shift register unit. The shift register unit 10(N) is given as an example. Referring to FIG. 7, the discharging circuit 40 comprises switches T5', T6, T7, and T8*a*. Each of the switches T5', T6, T7, and T8*a* has a control terminal, an input terminal, and an output terminal. In the embodiment of FIG. 7, the switches T5', T6, T7, and T8*a* are implemented by N-type transistor. For each of the switches T5', T6, T7, and T8*a*, the control terminal, the input terminal, and the output terminal are referred to as the gate, the drain, and the source of the N-type transistor. As shown in FIG. 7, the gate of the transistor T5' is coupled to a node N2, the drain thereof is coupled to the output node OUT(N), and the source thereof is coupled to the low voltage terminal 41 (VGL). The gate of the transistor T6 receives the output signal generated by the following shift register unit. In the embodiment, the gate of the transistor T6 receives the output signal R(N+1) from the (N+2)-th shift register unit. Moreover, the drain of the transistor T6 is coupled to the node N1, and the source thereof is coupled to the low voltage terminal 41 (VGL). The gate of the transistor T7 is coupled to the node N1, the drain thereof is coupled to the node N2, and the source thereof is coupled to the low voltage terminal 41 (VGL). The gate and drain of the transistor T8*a* are coupled to a high voltage terminal 70, and the source thereof is coupled to the node N2. In the embodiment, the high voltage terminal 70 provides a voltage with the high voltage level VGH. Accordingly, the transistor T8*a* is always turned on. Note that, in the embodiment of FIG. 7, the gate of the transistor T4 is coupled to the node N2 instead of the output signal R(N+1) in the embodiment of FIG. 4. Referring to FIGS. 3 and 7, in the period between the time point 33 to the time point 34, the output signal R(N+1) is at the high voltage level VGH to turn on the transistor T6, and the voltage signal V(N) at the node N1 is decreased to turn off the transistor T7. At this time, the voltage level at the node N2 is high according to the high voltage level VGH through the turned-on transistor T8*a* to turn on the transistors T4 and T5', and, thus, the node N1 and the output node OUT(N) are coupled to the low voltage terminal 41 (VGL). Accordingly, the beat at the node N1 induced from the clock signal CLK1 with the high voltage level VGH can be suppressed, and the extra pulse at the output node OUT(N) induced by channel leakage current can be prevented. Moreover, according to the connection structure of the transistor T8*a*, the transistor T8*a* acts as a diode. The anode and the cathode of the diode T8*a* are coupled to the high voltage level VGH and the node N2 respectively. The diode T8*a* provides negative threshold shift to the node N2 to enhance the tolerance to high ambient temperature when the node N1 and the output OUT(N) is continuously coupled to the low voltage terminal 41 (VGL) through the transistors T4' and T5' after the time point 33.

Figure 8:
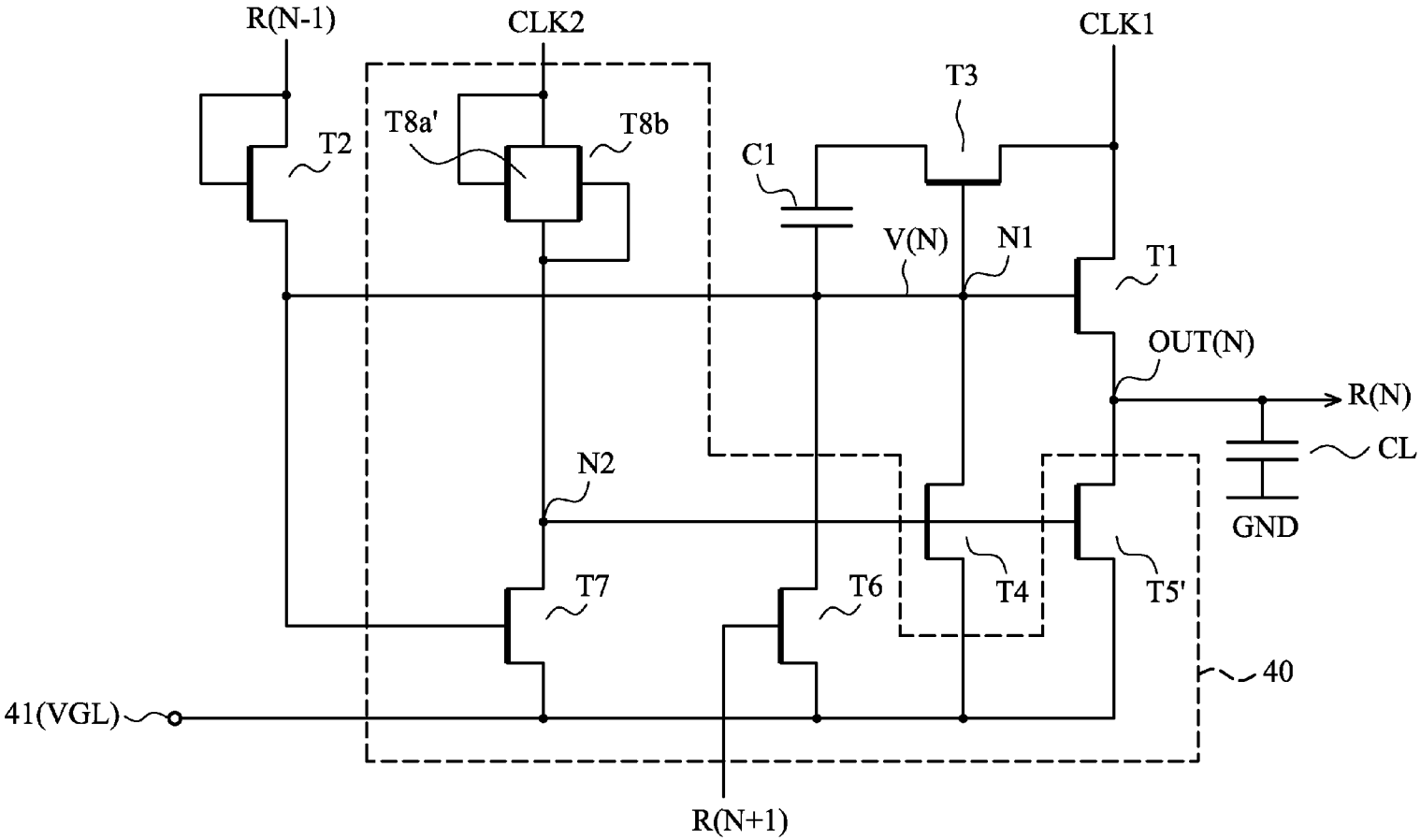
FIG. 8 shows further another exemplary embodiment of a discharging circuit in the register unit of FIG. 4.

FIG. 8 shows further another exemplary embodiment of the discharging circuit 40 in each shift register unit. The shift register unit 10(N) is given as an example. Referring to FIG. 8, the discharging circuit 40 comprises switches T5', T6, T7, T8*a*', and T8*b*. The connection structures and operations of the switches T5', T6, T7 have been described in the embodiment of FIG. 7, and, thus, the related description is omitted. Each of the switches T8*a*' and T8*b* has a control terminal, an input terminal, and an output terminal. In the embodiment of FIG. 8, the switches T8*a*' and T8*b* are implemented by N-type transistor. For each of the switches T8*a*' and T8*b*, the control terminal, the input terminal, and the output terminal are referred to as the gate, the drain, and the source of the N-type transistor. As shown in FIG. 8, the gate and drain of the transistor T8*a*' receive the clock signal CLK2, and the source thereof is coupled to the node N2. The drain of the transistor T8*b* receives the clock signal CLK3, and the gate and source thereof are coupled to the node N2. According to the connection structures of the transistors T8*a*' and T8*b*, each of the transistors T8*a*' and T8*b* acts as a diode. The diodes T8*a*' and T8*b* are coupled in parallel. In detailed, the anode and the cathode of the diode T8*a*' are coupled to the cathode and the anode of the transistor T8*b* respectively. Note that that the clock signal CLK2 switches between the high voltage level VGH and the low voltage level VGL is provided to the anode of the diode T8*a*' and the cathode of the diode T8*b*. Referring to FIGS. 3 and 8, after the time point 33, when the clock signal CLK2 is at the high voltage level VGH, the diode T8*a*' provides negative threshold shift to the node N2. When the clock signal CLK2 is at the low voltage level VGL after the time point 33, the threshold of the diode T8*b* is used to compensate the negative threshold shift provided by the diode T8*a*'.

Figure 9:
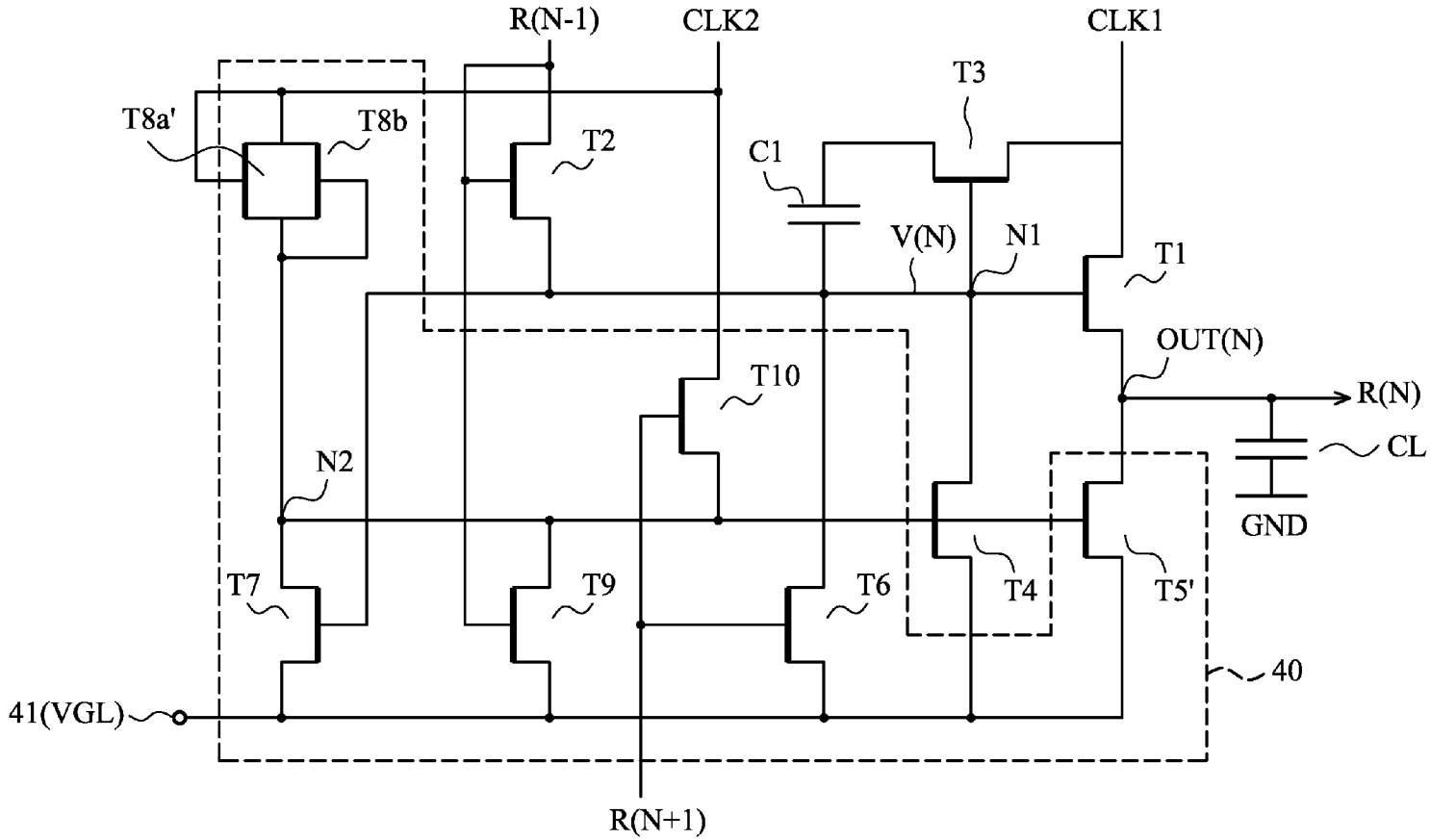
FIG. 9 shows another exemplary embodiment of a discharging circuit in the register unit of FIG. 4.

FIG. 9 shows another exemplary embodiment of the discharging circuit 40 in each shift register unit. The shift register unit 10(N) is given as an example. Referring to FIG. 9, the discharging circuit 40 comprises switches T5', T6, T7, T8*a*', T8*b*, T9, and T10. The connection structures and operations of the switches T5', T6, T7, T8*a*', and T8*b* have been described in the embodiments of FIGS. 7 and 8, and, thus, the related description is omitted. Each of the switches T9 and T10 has a control terminal, an input terminal, and an output terminal. In the embodiment of FIG. 9, the switches T9 and T10 are implemented by N-type transistor. For each of the switches T9 and T10, the control terminal, the input terminal, and the output terminal are referred to as the gate, the drain, and the source of the N-type transistor. As shown in FIG. 9, the gate of the transistor T9 is coupled to the gate of the transistor T2, the drain thereof is coupled to the node N2, and the source thereof is coupled to the low voltage terminal 41 (VGL). The gate of the transistor T10 is coupled to the gate of the transistor T6, the drain thereof receives the clock signal CLK2, and the source thereof is coupled to the node N2. According to the connection of the gates of the transistors T9, and T10, the gate of the transistor T9 receives the output signal S(N−1) generated by the (N−1)-th shift register unit 10(N−1), and the gate of the transistor T10 receives the output signal R(N+1) from the (N+1)-th shift register unit. The transistors T9 and T10 are use to control the voltage level at the node N2 for changing the states of the transistors T4 and T5', thereby improving the transient speed of the output signal R(N).

Figure 10:
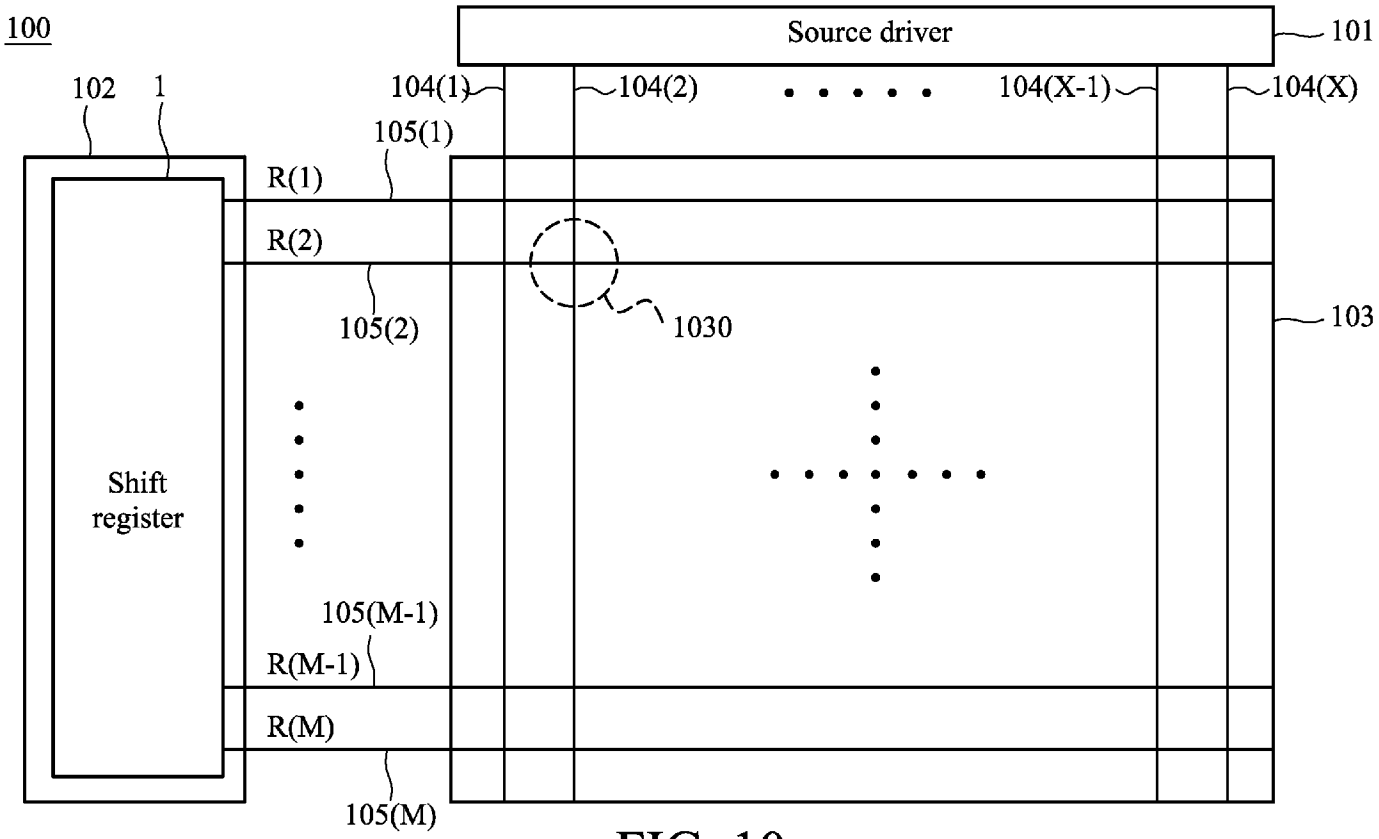
FIG. 10 shows an exemplary embodiment of a display panel employing the shift register of FIG. 1.

FIG. 10 shows an exemplary embodiment of a display panel. As shown in FIG. 10, a display panel 100 comprises a source driver 101, a gate driver 102, a display array 103, and a plurality of source lines 104(1)~104(X), and a plurality of gate lines 105(1)~105(M), wherein X is a positive integer. The gate lines 105(1)~105(M) interlace with the source lines 104(1)~104(X). The display array 103 comprises a plurality of pixel units 1030 arranged in a matrix, and each pixel unit corresponds to one set of the interlaced source and gate line. The source driver 101 is coupled to the source lines 104(1)~104(X) and used to provide data signals to the display array 103 through the source lines 104(1)~104(X). The gate driver 102 is coupled to the gate lines 105(1)~105(M). Referring to FIG. 10, the gate diver 102 comprises the shift register 1 of FIG. 1. The shift register 1 generates the output signal R(1)~R(M), and the output signal R(1)~R(M) are provided to the display array 103 through the gate lines 105(1)~105(M) respectively. In the embodiment, the display panel 100 is a liquid crystal display panel.

Figure 11:
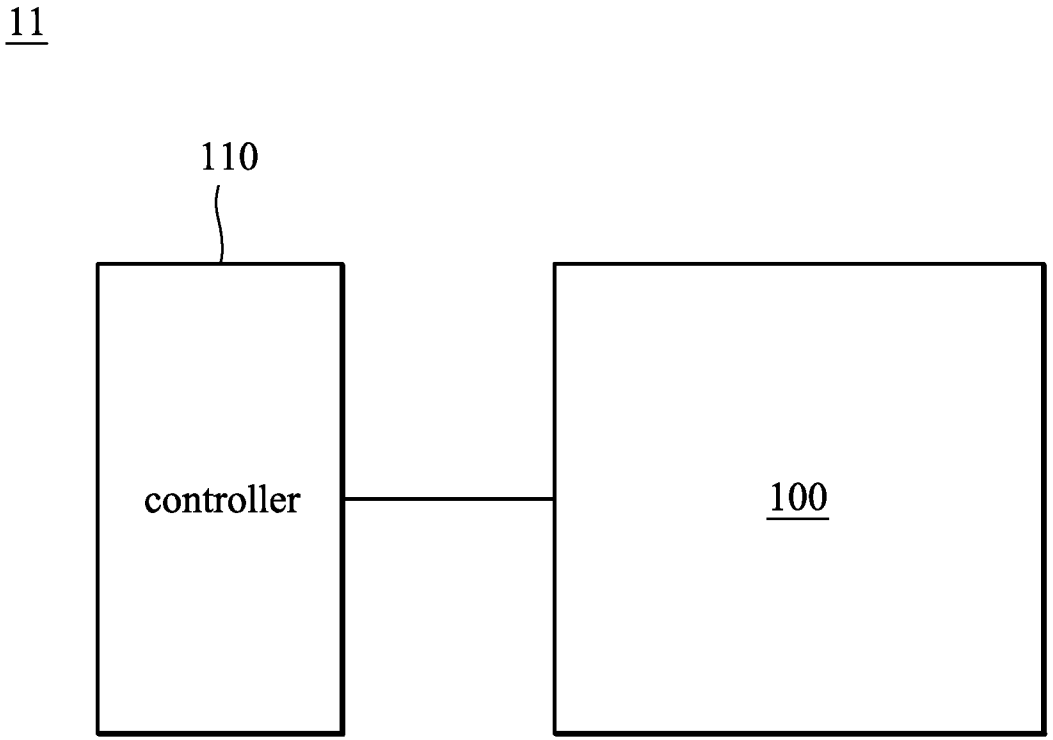
FIG. 11 shows exemplary embodiment of a display device employing the display panel of FIG. 10.

FIG. 11 shows exemplary embodiment of a display device employing the disclosed display panel 100. Generally, a display device 11 includes a controller 110, and the display panel 100 shown in FIG. 10, etc. The controller 110 is operatively coupled to the display panel 100 and provides control signals, such as clock signals, start pulses, or image data, etc, to the display panel 100.

Figure 12:
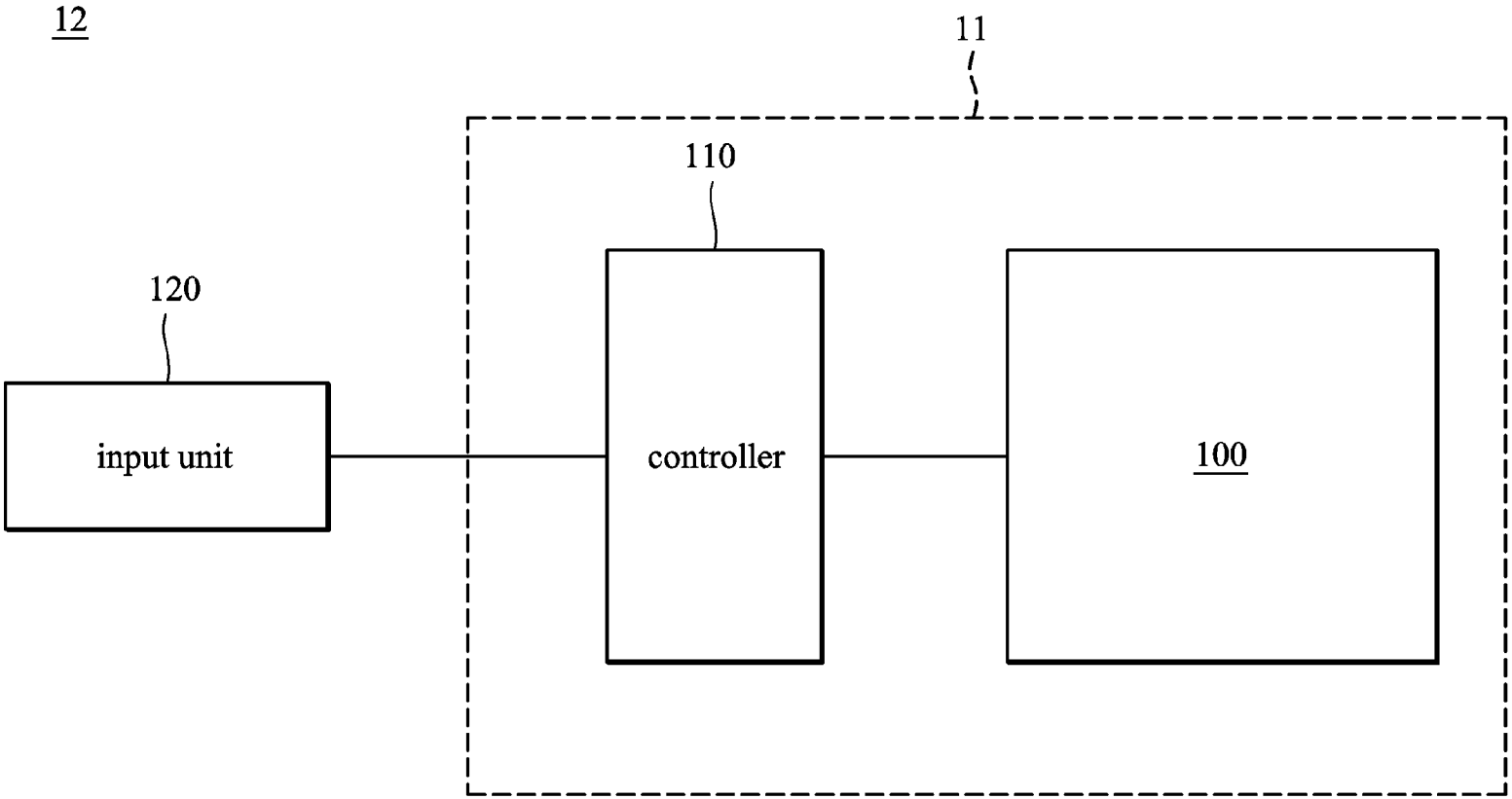
FIG. 12 shows an exemplary embodiment of an electronic device employing the display device of FIG. 11.

FIG. 12 shows an exemplary embodiment of an electronic device employing the disclosed display device 11. An electronic device 12 of the embodiment may be a portable device such as a PDA (personal digital assistant), a digital camera, a display monitor, a notebook computer, a tablet computer, a cellular phone, or similar. Generally, the electronic device 12 comprises an input unit 120 and the display device 11 shown in FIG. 11, etc. Further, the input unit 120 is operatively coupled to the display device 11 and provides input signals (e.g., image signal) to the display device 11. The controller 110 of the display device 11 provides the control signals to the display panel 100 according to the input signals.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A shift register comprising:

a plurality of successively cascaded shift register units, each controlled by a first clock signal to generate an output signal at an output node, wherein the output signals generated by the cascaded shift register units are enabled successively, and each of the shift register units comprises:

a first switch having a control terminal coupled to a first node, an input terminal receiving the first clock signal, and an output terminal coupled to the output node;

a second switch having a control terminal, an input terminal coupled to the control terminal of the second switch, and an output terminal coupled to the first node;

a third switch having a control terminal coupled to the first node (N1), an input terminal receiving the first clock signal, and an output terminal;

a first capacitor coupled between the output terminal of the third switch and the first node;

a fourth switch having a control terminal, an input terminal coupled to the first node, and an output terminal coupled to a low voltage terminal; and a second capacitor coupled between the output node and a ground terminal, wherein for a current shift register unit among the shift register units, the control terminal of the second switch receives the output signal generated by previous shift register unit to the current shift register unit.

2. The shift register as claimed in claim 1, wherein for the current shift register units, the control terminal of the second switch receives the output signal generated by the last shift register unit, and the control terminal of the fourth switch receives the output signal received generated by the next shift register unit.

3. The shift register as claimed in claim 1, wherein each of the shift register units further comprises:

a discharging circuit, coupled to the output node, for coupling the output node to the low voltage terminal.

4. The shift register as claimed in claim 3, wherein each of the shift register units further comprises:

a third capacitor having a first terminal receiving a second clock signal and a second terminal coupled to the first node, wherein the second clock signal is complementary to the first clock signal.

5. The shift register as claimed in claim 4, wherein for the current shift register units, the control terminal of the second switch receives the output signal generated by the last shift register unit, and the control terminal of the fourth switch receives the output signal received generated by the next shift register unit.

6. The shift register as claimed in claim 3, wherein the discharging circuit of each of the shift register units comprises:

a fifth switch having a control terminal coupled to the control terminal of the fourth switch, an input terminal coupled to the output node, and an output terminal coupled to the low voltage terminal.

7. The shift register as claimed in claim 6, wherein for the current shift register units, the control terminal of the second switch receives the output signal generated by the last shift register unit, and the control terminal of the fourth switch receives the output signal received generated by the next shift register unit.

8. The shift register as claimed in claim 3, wherein the discharging circuit of each of the shift register units comprises:

a fifth switch having a control terminal coupled to the control terminal of the fourth switch at a second node, an input terminal coupled to the output node, and an output terminal coupled to the low voltage terminal;

a sixth switch having a control terminal, an input terminal coupled to the first node, and an output terminal coupled to the low voltage terminal;

a seventh switch having a control terminal is coupled to the first node, an input terminal coupled to the second node, and an output terminal coupled to the low voltage terminal; and a eighth switch having a control terminal coupled to a high voltage terminal, an input terminal coupled to the control terminal of the eighth switch, and an output terminal coupled to the second node, wherein for the current shift register unit, the control terminal of the sixth switch receives the output signal generated by the following shift register unit to the current shift register unit.

9. The shift register as claimed in claim 8, wherein for the current shift register units, the control terminal of the second switch receives the output signal generated by the last shift register unit, and the control terminal of the sixth switch receives the output signal received generated by the next shift register unit.

10. The shift register as claimed in claim 3, wherein the discharging circuit of each of the shift register units comprises:

a fifth switch having a control terminal coupled to the control terminal of the fourth switch at a second node, an input terminal coupled to the output node, and an output terminal coupled to the low voltage terminal;

a sixth switch having a control terminal, an input terminal coupled to the first node, and an output terminal coupled to the low voltage terminal;

a seventh switch having a control terminal is coupled to the first node, an input terminal coupled to the second node, and an output terminal coupled to the low voltage terminal;

a eighth switch having a control terminal coupled to a second clock signal, an input terminal coupled to the control terminal of the eighth switch, and an output terminal coupled to the second node;

a ninth switch having a control terminal coupled to the second node, an input terminal coupled to the second clock signal, and an output terminal coupled to the control terminal of the ninth switch;

wherein for the current shift register unit, the control terminal of the sixth switch receives the output signal generated by the following shift register unit to the current shift register unit, and wherein the second clock signal is complementary to the first clock signal.

11. The shift register as claimed in claim 10, wherein for the current shift register units, the control terminal of the second switch receives the output signal generated by the last shift register unit, and the control terminal of the sixth switch receives the output signal received generated by the next shift register unit.

12. The shift register as claimed in claim 11, wherein the discharging circuit of each of the shift register units comprises:

a tenth switch having a control terminal coupled to the control terminal of the second switch, an input terminal coupled to the second node, and an output terminal coupled to the low voltage terminal; and a eleventh switch having a control terminal coupled to the control terminal of the sixth switch, an input terminal receiving the second clock signal, and an output terminal coupled to the second node.

13. The shift register as claimed in claim 12, wherein for the current shift register units, the control terminal of the second switch receives the output signal generated by the last shift register unit, and the control terminal of the sixth switch receives the output signal received generated by the next shift register unit.

14. The shift register as claimed in claim 1, wherein the shift register is processed with amorphous silicon technology.

15. The shift register as claimed in claim 1, wherein the shift register is processed with low temperature poly-silicon technology.

16. The shift register as claimed in claim 1, wherein the shift register is oxide thin film transistor technology.

17. A display panel comprising:

a plurality of source lines;

a plurality of gate lines interlacing with the gate lines a plurality of pixel units arranged to form a display array, wherein each pixel unit corresponds to one set of the interlaced source line and gate line;

a source driver, coupled to the source lines, for providing data signals to the display array through the source lines; and a gate driver coupled to the gate lines;

wherein the gate driver comprises a shift register as claimed in claim 1 for generating output signals to the display array through the gate lines.

18. A display device comprising:

a display panel as claimed in claim 17; and a controller operatively coupled to the display panel.

19. An electronic device comprising:

a display device as claimed in claim 18; and an input unit operatively coupled to the display device.

20. The electronic device as claimed in claim 19, wherein the electronic device is a PDA (personal digital assistant), a digital camera, a display monitor, a notebook computer, a tablet computer, or a cellular phone.

* * * * *